US010081482B1

(12) United States Patent
Steines

(10) Patent No.: US 10,081,482 B1
(45) Date of Patent: Sep. 25, 2018

(54) LIQUID DISPENSING CONTAINER

(71) Applicant: Michael Steines, Fort Lee, NJ (US)

(72) Inventor: Michael Steines, Fort Lee, NJ (US)

( * ) Notice: Subject to any disclaimer, the term of this patent is extended or adjusted under 35 U.S.C. 154(b) by 0 days.

(21) Appl. No.: 15/868,560

(22) Filed: Jan. 11, 2018

(51) Int. Cl.

| | |
|---|---|
| ***B67D 7/06*** | (2010.01) |
| ***B65D 83/00*** | (2006.01) |
| ***B65D 35/44*** | (2006.01) |
| ***B65D 25/54*** | (2006.01) |
| ***B65D 47/12*** | (2006.01) |
| ***B65D 35/08*** | (2006.01) |

(52) U.S. Cl.
CPC ..... *B65D 83/0055* (2013.01); *B65D 25/54* (2013.01); *B65D 35/08* (2013.01); *B65D 35/44* (2013.01); *B65D 47/122* (2013.01); *B65D 47/127* (2013.01)

(58) Field of Classification Search
CPC .... B65D 83/0055; B65D 25/54; B65D 35/05; B65D 35/44; B65D 47/122; B65D 47/127; B65D 2501/0045; B65D 55/16
USPC ..... 222/181.3
See application file for complete search history.

(56) References Cited

U.S. PATENT DOCUMENTS

| | | | | |
|---|---|---|---|---|
| 5,050,757 | A * | 9/1991 | Hidding | B65D 21/0237 215/383 |
| 5,897,010 | A * | 4/1999 | Soyka, Jr. | B65D 23/12 215/383 |
| 7,225,937 | B2 * | 6/2007 | Schroeder | B65B 61/202 206/497 |
| 2008/0142466 | A1 * | 6/2008 | Balitski | B65D 23/12 215/6 |
| 2008/0308521 | A1 * | 12/2008 | Caporaso | A61J 7/0046 215/383 |
| 2009/0134112 | A1 * | 5/2009 | Reeves | A61J 11/008 215/11.6 |
| 2009/0152231 | A1 * | 6/2009 | Hanson | B65D 23/12 215/306 |
| 2010/0065527 | A1 * | 3/2010 | Zuberi | B65D 23/003 215/329 |

* cited by examiner

*Primary Examiner* — Benjamin R Shaw
(74) *Attorney, Agent, or Firm* — Day Pitney LLP

(57) ABSTRACT

A container for holding and dispensing liquid, comprising an elongated body and a lid having a spout and releasable cap. The elongated body comprises a groove therein configured to releasably receive and hold the releasable cap having a similar shape to the groove. The releasable cap itself comprises, on at least one side thereof, an attachment to secure the releasable cap to a wall to releasably hold in place the releasable cap and thereby the container. The container is preferably squeezable to release liquid product from the container through a spout having an o-ring configured to seal the spout and hold the liquid within the container until squeezed.

13 Claims, 4 Drawing Sheets

LIQUID DISPENSING CONTAINER

FIELD OF THE INVENTION

The present invention relates to a container for dispensing liquid, and more particularly to a container for dispensing shampoo, soap, lotion, or other liquid products in the bathroom.

Whether at home or in public facilities, shampoo, conditioner, hand soap, body lotion, and other liquid products are used in a shower or bath or at a sink. Most often, these liquid products come in the form of disposable containers purchased at retail. However, when containers run low on their liquid contents, it can be difficult and time-consuming to remove any remaining liquid product for use, creating frustration and often wasted content if users simply throw out the old container and replace it with a new one. Disposable containers also lack a convenient "home" in a shower, and can be difficult to open with wet hands and also fall to the ground constantly, creating frustration for a user.

In many instances, gyms and other facilities provide permanent vessels in connection with a shower or sink adhered to a wall for dispensing liquid products. Likewise, users often have soap dispensers in their homes which match the décor of their bathroom. These permanent and non-disposable fixtures generally require the liquid product to be transferred from a disposable container thereto for dispensing to users, which can be burdensome and time-consuming as well, especially for heavy liquids which take time to seep from one vessel to another, and often results in leaks and wasted product. Often, these permanent fixtures can also be expensive.

Accordingly, there is a need for an easy, convenient, and inexpensive disposable container for liquid products which reduces waste and time required to dispense the same. In particular, there is a need for a semi-permanent fixture for use in connection with a shower or sink that supports easy dispensing of liquid products without the hassle or frustration of spilled liquid or delayed dispensing, but also provides a disposable container which can be easily replaced when necessary without waste or mess.

SUMMARY OF THE INVENTION

The present invention comprises a container having an elongated body and a lid. The lid has a spout and releasable cap, the releasable cap being connectable to said lid by a screw or snap. The container has a preferably elongated semi-cylindrical body with a flat side and opposing rounded side and a limacon cross-section. The container comprises a groove built therein which is configured to releasably receive and hold the cap when slid therein. Preferably the groove is positioned parallel to the container and perpendicular to the lid, such that the container is held upright when vertically placed on the wall. Preferably, the cap has a shape which matches the shape of the groove, and has one or more beveled edges, such that the cap can be held flush within the groove such that, when the cap is held within the groove, one side of the cap aligns flush with the flat side of the container. The cap comprises an attachment on one side, preferably the side aligned with the flat side of the container. The attachment is preferably a double-sided sticky tape. When the cap is held within the groove of the container, the attachment is configured to hold the cap, and thereby the container, in place on a wall.

The container is preferably squeezable to dispense the liquid held therein, and more preferably the container comprises at least one protrusion to release liquid from said container.

The spout of the lid preferably faces downward when the cap is held within the groove, and the downward spout comprises an o-ring configured to hold the liquid within the container until squeezed.

The container of claim preferably comprises at least one clear window to view the contents therein.

BRIEF DESCRIPTION OF THE DRAWINGS

FIG. 4D is a bottom plan view thereof with the cap on.

DETAILED DESCRIPTION OF THE INVENTION

It is an objection of the present invention to provide a container for a liquid product. The container is preferably made of bendable plastic, though other materials are envisioned. The container could be any geometric shape, having a width, depth, and a height, but is preferably largely semi-cylindrical, having a substantially limacon cross-sectional shape. The container preferably has a one flat side which can be rested flush against a wall when affixed thereto, with an outwardly rounded opposing side for ease of gripping or pushing the same to easily dispense liquid therefrom. It is envisioned that the container could be designed to resemble a cartoon character or other fictional figure, or any other shape as desired.

Figures 1A, 1B, 1C:
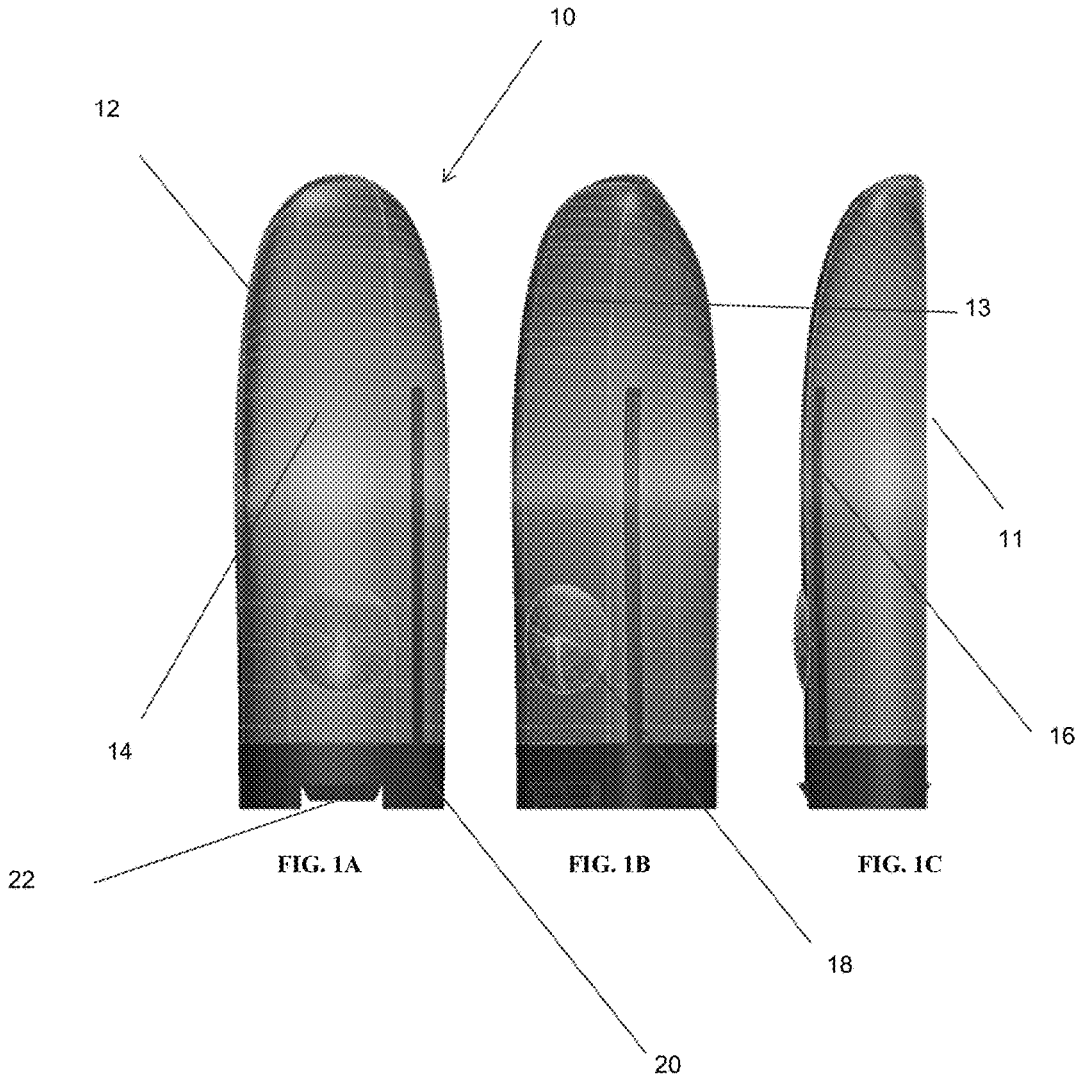
FIG. 1A is a front elevational view of the present invention liquid dispensing container.
FIG. 1B is a front perspective view thereof.
FIG. 1C is a side elevational view thereof.

As seen in FIGS. 1A-1C, the present invention comprises a container 10 for a liquid product. Container 10 preferably comprises two components, body 12 and lid 20. Container 10 preferably has a substantially flat side 11 and a an outwardly rounded side 13, with a substantially limacon cross-section. Lid 20 preferably comprises a cap 22. In a preferred embodiment, cap 22 can be entirely removed from lid 20, and is preferably connectable to the lid 20 either by a snap or screw. The container is preferably configured to be squeezed to dispense the liquid, such as by pressing a user's thumb on protrusion 18, to dispense the liquid product therein. Preferably, container body 12 has at least one clear window portion 16 to reveal the amount of liquid product left in container 10.

Figures 2A, 2B, 2C:
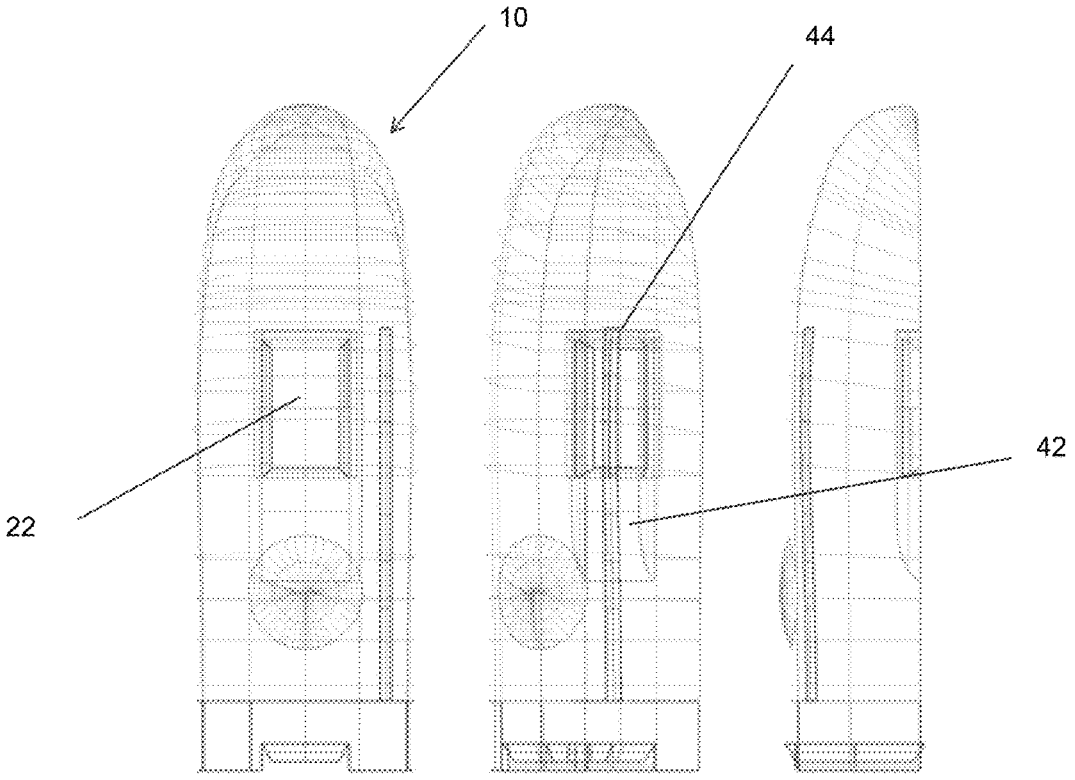
FIG. 2A is a line rendering of FIG. 1A.
FIG. 2B is a line rendering of FIG. 1B.
FIG. 2C is a line rendering of FIG. 1C.

As seen in FIGS. 2A-2C, on at least one side 14 of the container body 12, a groove 42 is preferably built into a side of the container, but could be affixed to the outside thereof. Groove 42 is configured to releasably hold cap 22. Preferably, groove 42 is positioned parallel to body 12 and perpendicular to lid 20, though it could be positioned in any direction desired. Groove 42 preferably comprises one closed end 44 designed to hold the cap 22 therein upon receipt. In another embodiment, cap 22 comprises an outwardly-protruding flange configured to be received within groove 42. However, for ease of explanation, the present invention will be explained by means of the preferred embodiment, whereby groove 42 is configured to receive the entire cap 22 to releasably hold the same. When cap 22 is releasably secured within groove 42, it is preferably aligned flush against and within groove 42, with one flat side 52 of cap 22 positioned such that it aligns with flat side 11 of body 12 so container 10 can be adhered to, and be flushly against, a wall.

Figure 3:
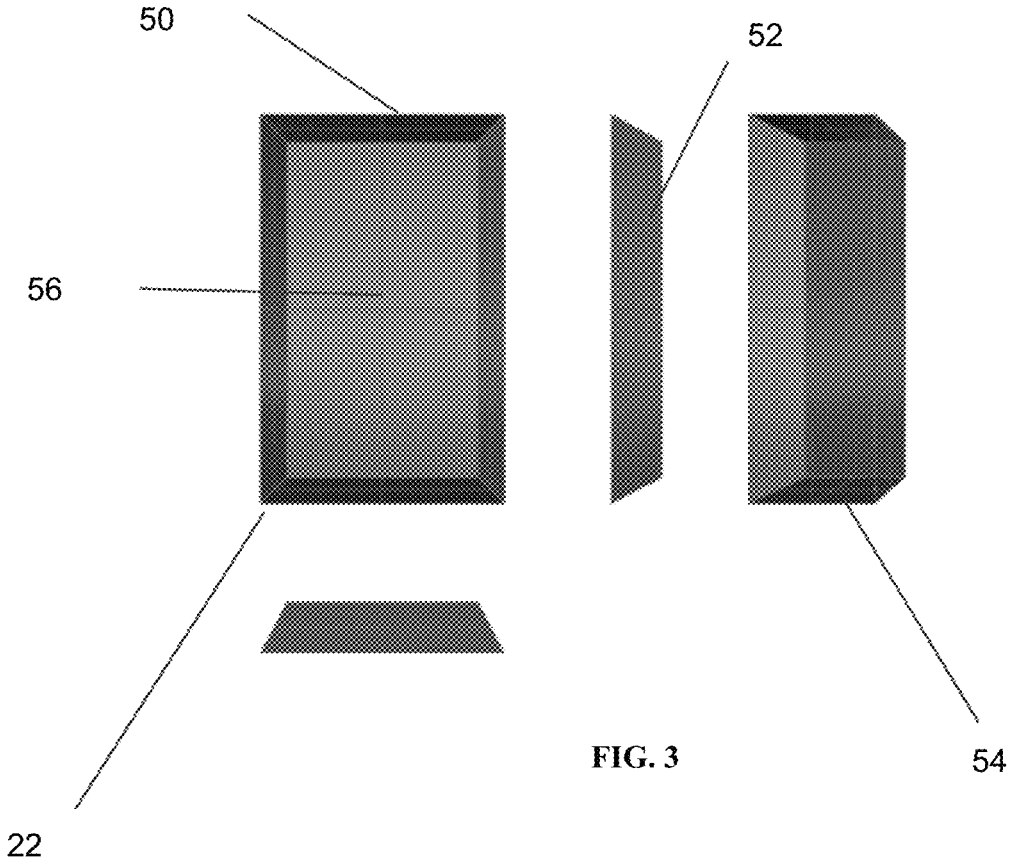
FIG. 3 shows top plan, front perspective, and horizontal and vertical cross-sections of the cap of the present invention seen in FIGS. 1A-1C.
Figure 4A:
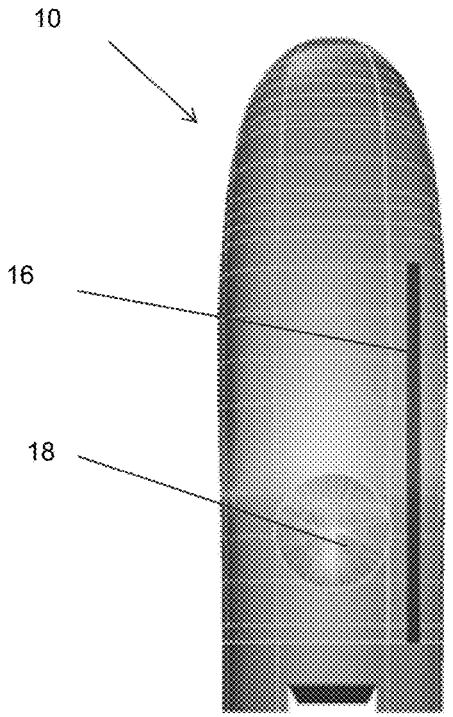
FIG. 4A is a front elevational view thereof.
Figure 4B:
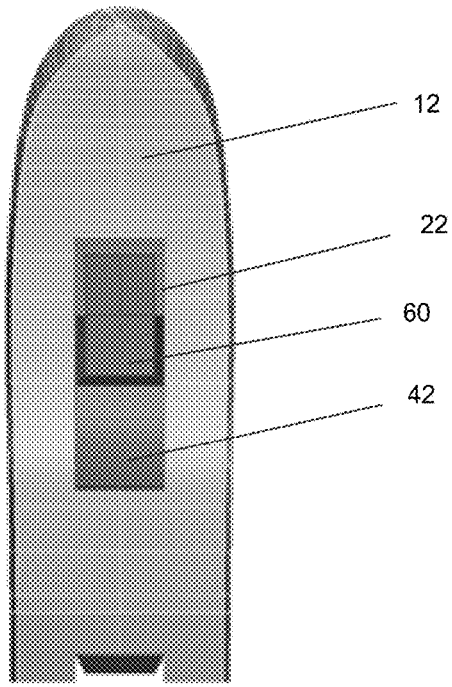
FIG. 4B is a rear elevational view thereof.
Figure 4C:
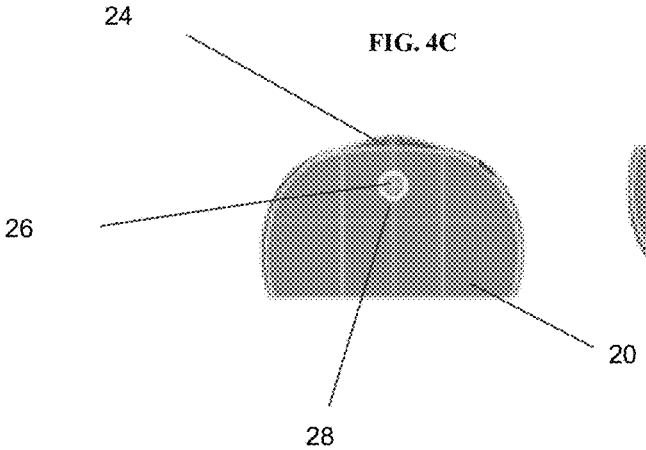
FIG. 4C is a bottom plan view thereof with the cap open.
Figure 4D:
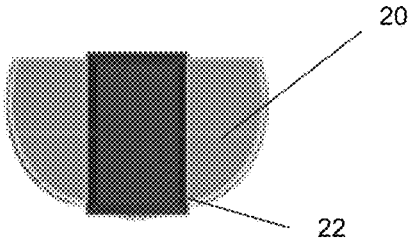

As seen in FIG. 3, on side 52, which is positioned opposite the side 56 which is positioned flush against body 12, cap 22 preferably comprises an attachment to hold the same in place on a wall. Preferably, the attachment is double sided tape, having a peel 50 that can be removed to reveal the sticky tape component 60 for securing cap 22 to the wall or wet surface, such as a shower wall, though the attachment can be any other known item (e.g., a suction cup or hook). Preferably the attachment is removable from the wall in a manner which will not leave permanent damage in case the cap 22 requires changing or the wall requires cleaning. Cap 22 preferably also has one or more beveled edged 54 configured to match the shape of the closed end 44 within the groove 42 to maximize the ability to hold container 10 on cap 22.

Turning to FIGS. 4A-4D, when container 10 is releasably secured to the wall by means of peel 50 (or other attachment) on cap 22, container 10 is preferably flush against the wall such that a user can push on protrusion 18 (thereby condensing the bottle between the user's fingers and the wall) to dispense some liquid product out of dispenser spout 26 of lid 20. Spout 26 is preferably placed underneath cap 22, which can then be revealed upon opening or removing cap 22 from lid 20. Spout 26 preferably points downward and away from container 10 when container 10 is held upright. Spout 26 preferably comprises an o-ring 28, preferably made of silicon or other similar material, configured to hold the liquid product within container 10 even when the cap 22 has been removed and the spout 26 is open and pointing towards the ground, such that the liquid can be dispensed by squeezing the container body 12 at protrusion 18 and forcing the liquid through the o-ring 28.

In this manner, a user can purchase an initial disposable container 10 of liquid product, remove cap 22, place cap 22 within groove 42, remove peel 50 to reveal the sticky tape, and attach the entire container 10 to a wall for future use. This preferably positions container 10 in a vertical manner such that spout 26 is facing downward such that the liquid in the container 10 can move towards the spout 26 to be easily dispensed upon squeezing the container 10 at protrusion 18, including when container 10 is nearly empty. This avoids the need for a user to shake the container and await the liquid to move from the bottom end of the container to the spout end for use, and also avoids the need to place the container on a ledge of the shower or bathroom counter where it will inevitably fall in or outside the shower or bath or behind a counter. Further, this avoids excess liquid product being dispensed or leaked, and eliminates the need to constantly open container caps that are often difficult to handle, particularly in the shower with wet hands.

When container 10 is empty, a user can easily slide groove 42 off of cap 22, which remains attached to a wall. A second container of liquid product 10 (whether the same or different product) can be purchased. The user can then remove the cap from the second container and attach the identical groove 42 of the second container on to cap 22 to hold the same on the wall. In an embodiment where cap 22 is not entirely removable from the container 10, but rather is connected on a hinge such that it can be unsnapped from the container and bent backward up to 270 degrees so as to connect with groove 42, cap 22 can be disconnected from the wall by unpeeling the sticky tape 60, and then the second container can be attached to the wall by removing peel 50 and unveiling its attachment.

Preferably, the present invention could be used with a variety of liquid products such that the lids and containers are interchangeable; that is, if a user has a shampoo container connected to the lid by means of the present invention, he or she can decide to replace that container at any time with a different shampoo container, a conditioner, a soap, or any other item dispensed from a similar bottle. It is envisioned that the present invention could be used in a commercial setting with bulk product, where the container, which may be quite large, may comprise an additional component such as a lock which must be undone in order to dispense the liquid.

It will be understood by those of ordinary skill in the art that various changes or modifications may be made and equivalents may be substituted for an element or particular feature without departing from the scope of the invention. Therefore, it is intended that the invention not be limited to the particular embodiments disclosed, but that the invention will include all embodiments falling within the scope of the claims.

What is claimed:

1. A container for holding and dispensing liquid, comprising:

an elongated body, having a flat side and an opposing rounded side; and a lid having a spout and releasable cap;

wherein said flat side of said elongated body comprises a groove configured to releasably receive said releasable cap which is configured to be slid and held therein, the releasable cap having a perimeter shape which matches a configuration of said groove such that, when said releasable cap is held within said groove, a first side of said releasable cap aligns flush with said flat side of said elongated body; and wherein said releasable cap comprises, on the first side thereof, an attachment to secure said releasable cap to a wall to releasably hold in place said releasable cap and thereby said container.

2. The container of claim 1, wherein said container is squeezable to dispense the liquid held therein.

3. The container of claim 2, further comprising at least one protrusion configured to be squeezed to release liquid from said container.

4. The container of claim 2, wherein said spout comprises an o-ring configured to hold the liquid within said container until squeezed.

5. The container of claim 1, wherein said attachment is a peelable surface and double-sided sticky tape.

6. The container of claim 1, wherein said groove is positioned parallel to said elongated body and perpendicular to said lid such that said elongated body is held vertically when said groove receives said releasable cap.

7. The container of claim 6, wherein said groove is positioned within said elongated body.

8. The container of claim 1, wherein said spout is positioned in a downward configuration when said groove receives said releasable cap.

9. The container of claim 1, wherein said container comprises a substantially limacon cross-section.

10. The container of claim 1, wherein said releasable cap comprises one or more beveled edges for securely and releasing being held in said groove.

11. The container of claim 1, wherein said elongated body comprises at least one clear window to view the contents of said container.

12. The container of claim 1, wherein said releasable cap is connectable to said lid by a screw or snap.

13. A container for holding and dispensing liquid, comprising:

an elongated body, having a flat side and an opposing rounded side and substantially limacon cross-section; and a lid having a spout and releasable cap, said releasable cap connectable to said lid by a snap;

wherein said flat side of said elongated body comprises a groove configured to releasably receive said releasable cap which is configured to be slid and held therein, the releasable cap having one or more beveled edges and a perimeter shape which matches a configuration of said groove such that, when said releasable cap is held within said groove, a first side of said releasable cap aligns flush with said flat side of said elongated body;

wherein said rounded side of said elongated body comprises a protrusion configured to be squeezed to release liquid from said container;

wherein said releasable cap comprises, on the first side thereof, an attachment to secure said releasable cap to a wall to releasably hold in place said releasable cap and thereby said container;

wherein said spout comprises an o-ring configured to hold the liquid within said container until squeezed; and wherein said elongated body comprises at least one clear window to view the contents of said container.

* * * * *